US006502735B1

(12) United States Patent
Krieger

(10) Patent No.: US 6,502,735 B1
(45) Date of Patent: Jan. 7, 2003

(54) DEVICE FOR THE SUSPENSION GUIDANCE OF A TRAVELLING WEB

(75) Inventor: Kurt F. Krieger, Monchengladbach (DE)

(73) Assignee: Kreiger GmbH & Co., Monchengladbach (DE)

( * ) Notice: Subject to any disclaimer, the term of this patent is extended or adjusted under 35 U.S.C. 154(b) by 0 days.

(21) Appl. No.: 08/624,610

(22) PCT Filed: Oct. 6, 1994

(86) PCT No.: PCT/DE94/01166

§ 371 (c)(1),
(2), (4) Date: May 21, 1996

(87) PCT Pub. No.: WO95/10473

PCT Pub. Date: Apr. 20, 1995

(30) Foreign Application Priority Data

Oct. 11, 1993 (DE) ..... 43 34 473

(51) Int. Cl.[7] ..... B65H 23/04
(52) U.S. Cl. ..... 226/196.1; 226/97.1; 226/97.3
(58) Field of Search ..... 226/196, 97, 196.1, 226/97.1, 97.3

(56) References Cited

U.S. PATENT DOCUMENTS

| | | | | | |
|---|---|---|---|---|---|
| 2,984,398 | A | * | 5/1961 | Chalmers | 226/97 X |
| 3,184,131 | A | * | 5/1965 | Fieldgate | 226/97 |
| 3,272,415 | A | * | 9/1966 | Wallin | 226/97 |
| 3,324,570 | A | * | 6/1967 | Flaith et al. | 226/97 X |
| 3,984,039 | A | * | 10/1976 | Hawley et al. | 226/97 |
| 4,131,320 | A | * | 12/1978 | Volat et al. | 226/97 X |
| 4,137,644 | A | * | 2/1979 | Karlsson | 226/97 X |
| 4,218,833 | A | | 8/1980 | Coar | |
| 4,271,601 | A | * | 6/1981 | Koponen et al. | 226/97 X |
| 4,605,146 | A | * | 8/1986 | Petitjean | 226/97 |
| 4,837,947 | A | * | 6/1989 | Krieger | 226/97 X |
| 5,317,817 | A | * | 6/1994 | Roberts et al. | 242/615.12 |

FOREIGN PATENT DOCUMENTS

| | | | | |
|---|---|---|---|---|
| DE | 3630571 | | 11/1922 | |
| DE | A3130450 | | 7/1981 | |
| EP | 0548419 A1 | | 12/1991 | |
| EP | A0561256 | | 3/1993 | |
| FR | A1149169 | | 3/1955 | |
| GB | A2146303 | | 4/1985 | |
| JP | 44967 | * | 4/1977 | 226/97 |
| JP | 2300051 | * | 12/1990 | 226/97 |
| JP | 3211152 | * | 9/1991 | 226/97 |

* cited by examiner

*Primary Examiner*—Gregory J. Strimbu
(74) *Attorney, Agent, or Firm*—Taylor & Aust, P.C.

(57) ABSTRACT

A device (100) for the suspension guidance of a travelling paper or paper-like web (B) by air and which is especially useful for deflecting a damp travelling paper web. The device has a plurality of air ducts (13) extending over the width of the web and bounded by wall surfaces (14). Each air duct (13) has a nozzle arrangement (22,22') communicating with a pressure chamber (10) to which compressed air is applied. In the air ducts (13) there are also air inlet apertures (26) which are not in fluid connection with the pressure chamber (10) but communicate through an intake duct (27) with an intake chamber (17) in which ambient pressure prevails and which has an inlet (19) for the fluid. Additional inlets (26) convey an additional quantity of air into each of the air ducts owing to the injector effect of the compressed air flowing into the air duct, thus preventing the web from forming a curvature transverse to the direction of its movement corresponding to the air duct cross-section and reducing the power consumption of the device by some 25% as compared with conventional suspension guidance devices.

26 Claims, 2 Drawing Sheets

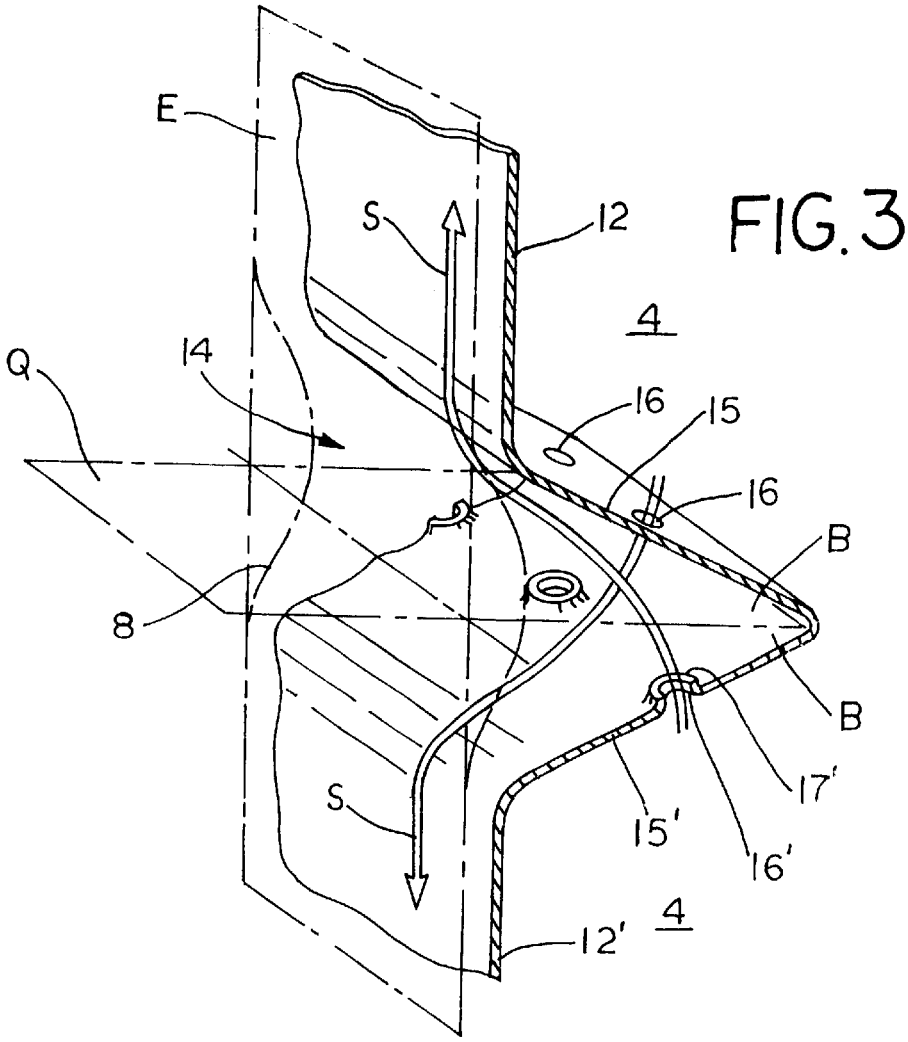
FIG. 3
FIG. 4
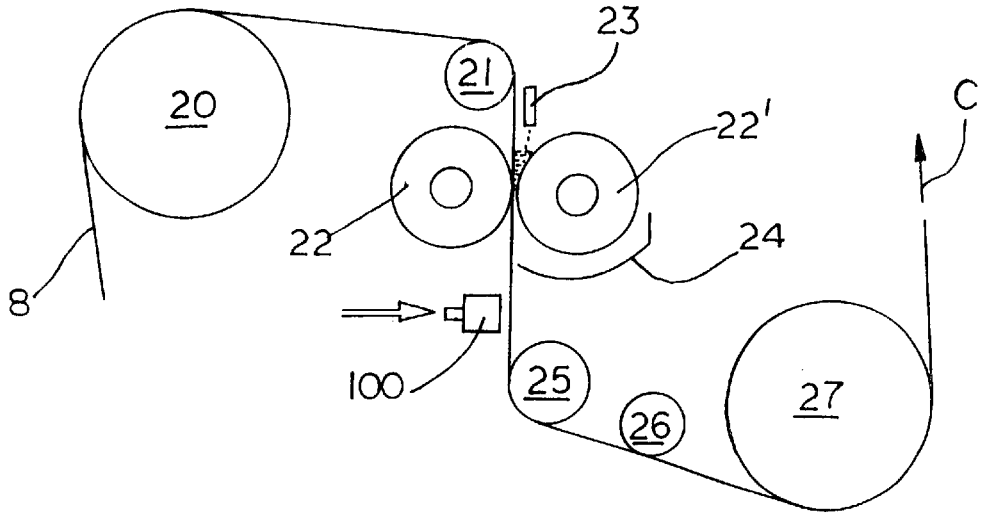

DEVICE FOR THE SUSPENSION GUIDANCE OF A TRAVELLING WEB

FIELD OF THE INVENTION

This invention relates to the handling of webs and especially damp or wet paper webs and more particularly to a web handling device using air currents which suitably support the web while employing significantly reduced energy required to produce the air currents.

BACKGROUND OF THE INVENTION

With the Production or processing of a web of a sensitive material, as, for example, paper or the like, it has proved advantageous for avoiding damage to the web or its surface to keep the web suspended for the duration of the drying process of the web material or its surface coating. Usually arrangements in connection with which air introduced from a blower over jets from one or both sides of the web is blown out against the web are used so that the web is borne by the air cushion so created. The air consequently circulating around the web accelerates the drying process, mostly assisted in addition by heating facilities extending over the width of the web. Since the trend in the production or processing of paper webs is toward ever higher operating speeds, while the drying rate of a unit area of web nonetheless has an upper limit, for example, owing to the maximum ability of the web material to take heat stress, this leads to the unit area having to be in a suspended state for a minimum period of time, and the webs must be guided under suspension for ever greater distances. Since, due to the relatively low strength, especially of wet paper webs, the maximally attainable distance between two successive suspension guideways is restricted, this development goes hand in hand with an ever greater number of support points necessary for the guidance of the web. On the one hand, this elevates the amount of air and therewith the energy required for guiding the web. On the other, it increases the space required by a drying device. The increased space requirement is usually taken into consideration by deflecting the paper web several times through which the floor area of the device is reduced with an equal length of freely suspended web section.

Devices with the aid of which a travelling web can be maintained or deflected in a suspended state are familiar in many forms of construction. Usually the devices include so-called nozzle boxes from which air exits in the direction of the web. Often the nozzles have the form of a slit (as for example in connection with a device in accordance with DE-PS 31 30 450). The nozzle boxes are arranged in the direction of travel of the web at a distance from one another, whereby the interstices serve as discharge pathways for the air, which then, as for example in the device familiar from GB-PS 13 07 695, basically escapes over the areas of the two web edges. The free escaping of the air over the web edges leads on the one hand to a great consumption of compressed air and therewith to a high energy demand, and on the other hand to an unstable running and unsatisfactory guidance of the web.

The device in accordance with DE-OS 29 32 794 seeks to improve on this by including air discharge nozzles running at right angles to the direction of travel of the web at the beginning and at the end of its deflection area, whereby the air current directed through them against the web induces an improved web support on the boundaries of the device and consequently prevents the web from touching the device. On the other hand, slit-like air discharge nozzles are provided in the area of the two web edges which inhibit the air discharge currents on the web edge side and consequently generate pressure heads in the web edge areas which exert a positive influence on the guidance of the web. The web deflection device described in DE-OS 29 32 794 has, however, the disadvantage that the energy demand is further increased owing to the auxiliary jets though which additional compressed air must be blown in.

The device according to DE-PS 31 04 656 represents a further development of DE-OS 29 32 794 in connection with which good characteristics with respect to the guidance and the stable running of the web are supposed to be obtained through a special selection of nozzle cross sections and their geometrical arrangement. The energy consumption to be expected is nevertheless still quite high due to the multiplicity of nozzles to be charged with compressed air.

A device for drying and/or keeping a moving web is familiar from DE 33 31 856 A1 which presents a series of air beams running parallel to one another, in which at all times a pair of elongated Coanda nozzles extending lengthwise toward the air beams are placed. Compressed air flows out of an air chamber provided in the device through the Coanda nozzles in the form of currents which provide contact-free support of the web of material guided over the device. In order to prevent an excessive amount of air from exiting on the sides of the device or on the side edges of the web of material, the first air barriers, which impede lateral air flow, are on the one hand provided at the ends of the air ducts formed between two adjacent air beams. On the other hand, the second air barriers, which border the web laterally are provided mounted on the upper side of the device and extending vertically upward this. The disadvantage in therefrom connection is that, for an effective reduction of air demand and therewith of energy consumption, the distance between the second air barriers and the web of material must be as small as possible, which is, however, possible only with a very exact guidance of the material web, as the web otherwise can be damaged by possible contacts with the air barriers.

Furthermore, devices for contact-free guidance of webs of material are familiar from GB 21 46 303 and DE 27 52 572 C2, in connection with which the special geometrical arrangement and construction of the air discharge nozzles lead to a stabilization of the travel of the web with the former. With the latter, these should make their applicability in connection with especially sensitive webs of material possible. Measures which could serve to reduce the high air requirement to be expected with both devices cannot be extracted from these writings.

A further formula for a web guidance device is familiar from DE 36 26 016 A1. With this formula, an improved guidance action on the web is achieved by providing air ducts installed at right angles to the direction of travel of the web as nozzle boxes which include lateral duct partitions forming a sharp angle to one another, whereby a series of nozzles is incorporated into each duct partition in such a manner that each nozzle lies opposite a deflector for the outflowing air formed by the other duct partition. By using the Coanda effect, a suitable air current is created for the stabilization of the web. The disadvantage with this web guidance arrangement is that the web has a tendency to arch along an isobar into the air duct, since reduced pressure prevails above each air duct on the basis of Bernoulli's law for fluid media.

This tendency is counteracted by a further familiar device available from the Krieger company, Mönchengladbach by providing auxiliary nozzles charged with compressed air on the floor of each air duct which subject the air duct to just such an additional amount of air that the isobar along which the web curves basically extends evenly over the surface of the device.

A very stable web guidance is, to be sure, obtained with this device, but the energy requirement necessitated for conveying the air, which comes to approximately 25 kW/m of web width, is quite high.

A device is known from FR-A 2 334 599 in which inlet apertures are provided between two adjacent slit-like air discharge nozzles through which additional air for supporting the web of material is drawn in by means of ejector action. The web guidance behavior should be improved by this measure.

BRIEF DESCRIPTION OF THE INVENTION

Underlying the invention is the task of carrying on development of a device suitable for its type in such a way that the energy required is considerably reduced without having to accept sacrifices with regard to the web guidance behavior of the device.

Improving a device suitable for its type with respect to its functionality is the objective underlying the invention.

This task is accomplished by the invention for suspension guidance of a travelling web by means of air or another fluid medium, especially for use to deflect a wet paper web, with one or more air ducts (13) provided on at least one side of the web and which extend over the width of the web, with partition surfaces (14) provided alongside the air ducts (13), and with at least one nozzle arrangement (22, 22') provided alongside each air duct (13), which communicates with a pressure chamber (10), which is acted upon by the fluid medium under an overpressure, wherein, in at least one air duct (13), inlet apertures (26) are provided for the fluid medium, which are fluidly connected with a second chamber independent of said pressure chamber (10), a pressure in said second chamber being lower than a pressure in said pressure chamber (10).

At least one part of the fluid medium drawn in by ejector action is drawn off from an area of increased pressure through the inlet apertures situated near the long end of the partition surfaces facing the web of material according to the invention, through which the efficiency and the web guidance behavior of the device is improved.

An additional amount of fluid medium can be conveyed into the air ducts by the ejector action of the medium flowing in under an overpressure owing to the nozzle arrangement provided in the air duct without an increased pump output being necessary for this through the inlet apertures provided in the air duct which are not fluidly connected with the pressure chamber. Compensating for the inrush of pressure above the air ducts now no longer requires actively blowing in additional amounts of fluid medium over separate injection nozzles installed in the air duct, but rather takes place automatically by means of fluid medium drawn in through the ejector action over the inlet apertures. Experiments have shown that the energy requirement of a device of appropriate type can be reduced by 25% through construction in accordance with the invention.

With the preferred embodiment, the inlet apertures each communicate with a separate intake chamber which has an inlet aperture for the fluid medium, through which the fluid medium is sucked off in a targeted manner from a predeterminable region of the environment and can, if necessary, be purified by a filter element or the like with a central location or installed in the intake chamber prior to passing through the inlet apertures.

To increase the degree of efficiency of the device, it is advantageous to provide inlet apertures near the edge of the band edge, as fluid medium is sucked out of an area of elevated pressure through this construction.

The elevated pressure of the fluid medium in the vicinity of the band edges and the flow components thereby directed outwardly can be additionally utilized by providing at least one flow glide sheet partially surrounding the inlet apertures.

Experiments have shown that energy savings of up to 25% can be obtained with a device of the invention constructed in this manner.

There exist numerous possibilities for construction of the air ducts in connection with the device of the invention. Experiments have shown that a configuration of the air duct is particularly advantageous where duct partitions are provided arranged on apposite sides of a transverse plane lying lengthwise in relation to the air duct which stands vertically on the tangential plane constructed on its line of intersection formed with the web.

In an especially convenient embodiment, the nozzle arrangement consists of a series of individual outlet apertures which are mounted in the one duct partition opposite the air current deflectors formed by the other duct partition. Very favorable air current conditions can be obtained through the fact that in a form of construction of this type, the duct partitions are constructed in the area of the emerging air currents as current deflectors. In particular, it is possible to create air currents especially low in turbulence which follow the surface of the respective duct partition according to the so-called Coanda effect.

A further evening out of the air currents can be created in that the discharge apertures are constructed as holes which are surrounded concentric deflector edges projecting into the air duct.

For creating a current extending symmetrically from the air duct over the surface of the device, it is advantageous if two duct partitions arranged immediately opposite each other, provided with a discharge outlet, form an air duct, and each of these duct partitions forms, at least in part, a deflector for currents of the fluid medium for fluid currents emerging from the outlets of the other duct partition. The tendency to form strong turbulence is diminished if the outflows of the one duct partition are mounted with lateral displacement in relation to the discharge apertures of the other duct partition.

If the device includes several air ducts, it is furthermore of particular advantage for diminishing the tendency to form harmful turbulence if the discharge apertures in one duct partition of an air duct are placed opposite the discharge apertures provided in the other duct partition of an adjacent air duct.

The device of the invention is then likewise especially suited for attaining low turbulence air currents when it is constructed so that at least one lateral area of each duct wall has a convex curvature in the direction of web movement and wherein the curved lateral area merges into one side of the partition surfaces since an even, edge free guidance of the air currents from the air ducts is thereby made possible.

The air ducts have partitions lying opposite one another forming an acute angle and being symmetrical about a transverse plane, the air duct having a lower boundary which coincides with the vertex of said acute angle is especially suited for using the ejector action of the inflowing medium.

To obtain the maximal ejector effect, it is then advantageous to provide holes interrupting the lower boundary line of the air duct as inlet apertures.

It is however also possible with another preferred embodiment to provide inlet air nozzles over a considerable distance of the air duct extending along the lower boundary line instead of individual inlet apertures. This configuration of the inlet apertures is in particular recommended when both canal partitions consist of separate structural members which are then to be so arranged that they are placed at a distance in the lower region of the air duct corresponding to the necessary inlet air nozzle width. This form of construction has the advantage that no further processing steps are necessary for creating the inlet aperture.

It is beneficial in connection with a device designed for deflecting a web to provide several air ducts, the transverse planes of which intersect on a common line, so that the contour of the device is curved according to the direction of deflection.

For optimizing the guidance properties of the device, a configuration is here of advantage in connection with which the angular distance of neighboring transverse planes is almost constant. The formation of additional turbulence can be counteracted by the fact that the partition surfaces of the device are curved, advantageously with constant curvature radii.

For additional stabilization of the travelling web, it is advantageous if stabilization nozzles directed approximately radially outward are provided in the partition parts of the device placed at the beginning and end of the deflection area which communicate with the pressure chamber. Such stabilization nozzles help avoid harmful contacts between the web and the device even with a slight flutter of the web.

The device can also be used for suspension guidance or deflection of narrow webs without a major part of the flowing medium acted upon by pressure flowing unused into the surroundings with the disadvantages caused thereby owing to the pressure chamber being sectioned in a direction transverse to the direction of travel and owing to means for a separate pressure control being provided in the individual sections of the pressure chamber. Moreover, it is possible through this configuration of the device of the invention to raise the pressure of the sections acting on the edges of the web with the fluid medium relative to the further sections of the pressure chamber, through which the lateral guidance characteristics of the device are again improved. Advantageously, means for separate control of pressure consist of plate valves subject to continuous control interposed in individual sections.

BRIEF DESCRIPTION OF THE FIGURES

A form of construction of the invention is represented in the drawings.

Depicted is:

FIG. 1*a* is a simplified end view of FIG. 1.

FIG. 3 A partial representation of the same device (shown enlarged) in a view from above (showing the portion of the device in the region enclosed by the oval-shaped chain line labelled III in FIG. 1);

FIG. 4 A section through the same view of the device (Section IV—IV in FIG. 3);

FIG. 5 A perspective view of a cross section through an air duct according to line of intersection V—V in FIG. 1 in a perspective representation.

DETAILED DESCRIPTION OF THE INVENTION AND THE PREFERRED EMBODIMENTS THEREOF

Figure 1:
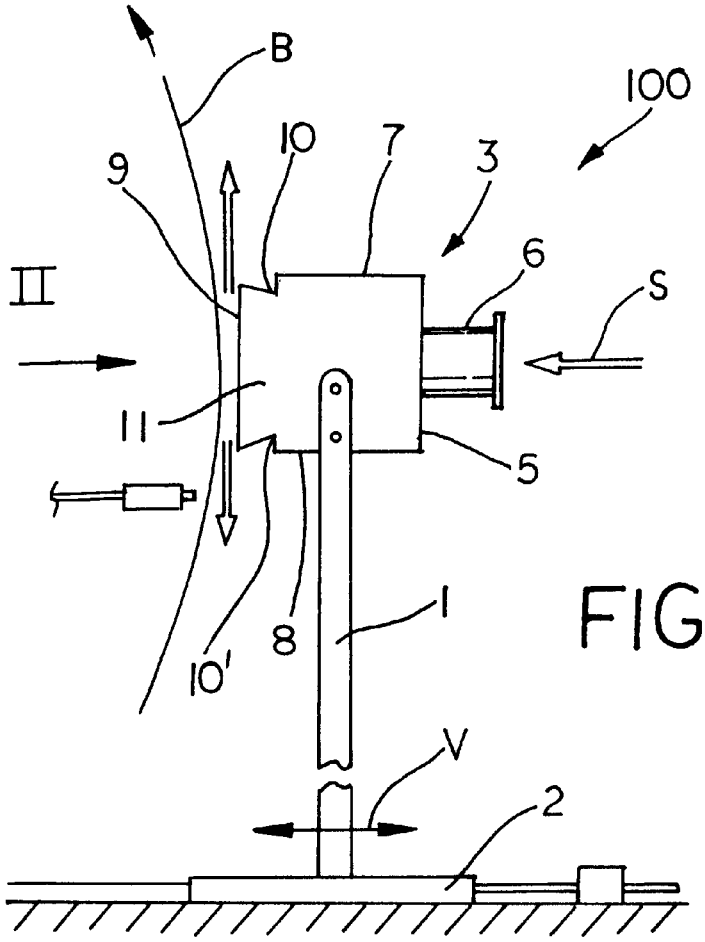
FIG. 1 A perspective representation of a form of construction of a device of the invention.

When "above" and "below" are used in the following, the indication refers to the upright operating position of the device presented in FIGS. 1 and 2, the indications "front," "left," or "right" r refer to the view in FIG. 2.

The device designated generally as 100 in the drawing serves for the suspension guided deflection of a web of paper B which executes a movement in the direction of arrow P. Although the surface 12 is curved, it nonetheless lies in the framework of the invention to equip the device with a flat upper side 12 and to use it for guiding a web travelling in a straight line.

The facilities for driving the web are not represented in the drawing and can be constructed in a familiar manner known in the art.

The device 100 includes a basically closed housing 1 which assumes the form of a cylinder segment, whereby the angular extension of the cylinder surface is in compliance with the path deflection angle required (approximately 120° in the form of construction depicted in the drawing). Two parallel longitudinal walls 2, 2' constitute the longitudinal boundary of the housing. The housing is bounded at its opposite lateral ends by means of side covers 3, 3' in the form of circle segments arranged parallel to each other which have straight lower edges running parallel to each other. The underside 4 of the housing, has air inlet apertures arranged symmetrically in relation to the longitudinal axis L of the device. An air supply duct 6 extending over the entire length of device 100 is provided below the lower partition 4, air inlet apertures 5 opening into the interior of the duct. Valve flaps 8 which can be activated from without by means of handles 7 are provided in the air supply duct 6, to alter the size of the air inlet apertures 5 through swivelling in one of the directions of the arrow K in FIG. 2. A flange 9 is situated at the open end of the air duct 6 which serves to connect an air supply hose (not depicted in the drawing), which usually creates the connection of the device to a blower.

The inner volume of the housing serving as a pressure chamber 10 is divided into sections by means of partitions 11 arranged parallel to the side covers 3, 3'. Each of the air inlet apertures 5 communicates with just one section of the pressure chamber 10, so that pressure profile extending over the width of the web B can be selectively adjusted by means of the valve flaps 8. It is in particular possible through this construction to subject the edges of the web to increased air pressure, through which an improved lateral guidance of the web is obtained.

The upper side 12 of the housing 1, which basically presents a constant curvature radius, includes a number (five (5) in the form of construction depicted in the drawing) of air ducts 13 extending parallel to one another over the entire width of the device, the configuration of which will be explained in detail further below.

Partition surfaces 14 forming the upper side 12 are provided between adjacent air ducts 13 which surfaces 14 are curved as a function of the curvature radius of the device. Arrangements of stabilizing nozzles extending over the entire width of the web B are provided in the outer partition surfaces 15, 15' at the beginning (i.e. downstream and) and end (i.e. downstream end) of the deflection area of the device

100 which communicate with the pressure chamber 10 and through which air for additional support of the web B is blown approximately radially outward through apertures 16, 16'.

Intake chambers 17 are provided at both ends of the device, the function of which will be explained in detail further below. The intake chambers include inlet apertures 19 surrounded by current deflectors 18 which are placed adjacent to the end, of the partition surfaces 14.

The construction and mode of action of the components of the device which are determinative for current conditions will be explained below on the basis of FIGS. 3 to 5.

Each air duct 13 includes two lateral duct partitions 20, 20' lying opposite to each other and which are curved convexly outwardly and toward the web and which at all times pass over into (i.e. merge with) a partition surface 14. As is apparent from FIG. 5, the duct partitions 20, 20' extended downwardly just far enough in the direction of the interior of the housing 1 that they intersect and form an acute angle β so that the air duct 13 has a straight, linear lower boundary 21. The curvatures of the duct partitions are selected so that the air duct 13 has a V-shaped cross section, whereby the duct partitions 20, 20' are arranged symmetrically with respect to a transverse plane Q lying lengthwise in relation to the air duct, which stands vertically on and stands through the tangential plane T. Line D is a curvature line of intersection with the web B, plane Q and plate T.

Figure 2:
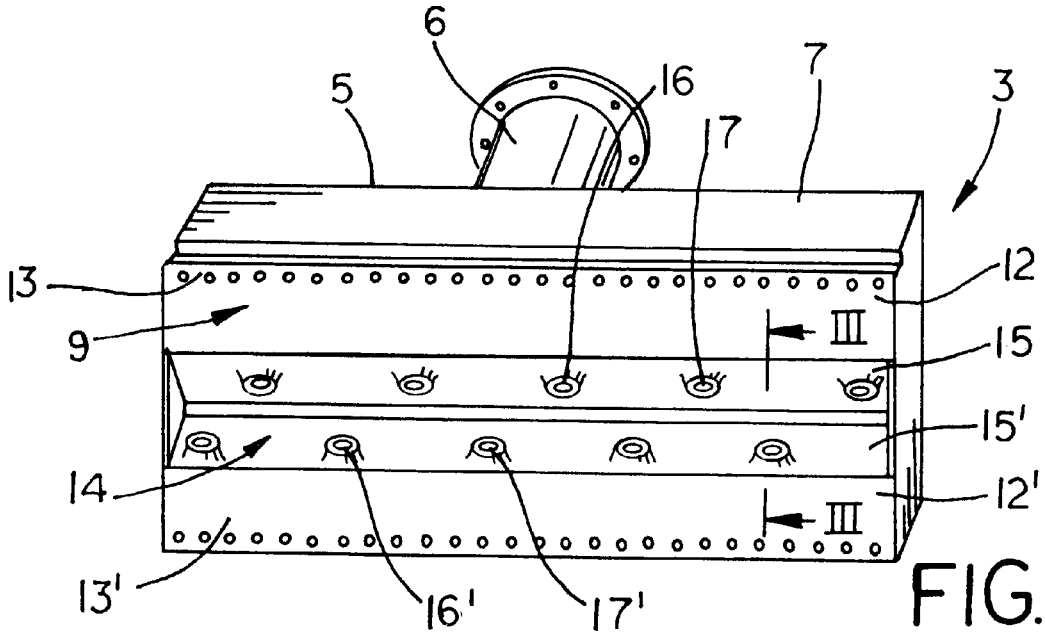
FIG. 2 The same device in elevation looking in the direction of arrow A in FIG. 1)

FIG. 1*a* is a simplified end view of the device of FIG. 1 wherein the transverse planes (Q) of each duct (13) can be seen to intersect along a common line ($L_1$).

Two arrays 22, 22' of nozzles, extending across the width of the web are respectively provided in the duct partitions 20, 20' of an air duct 13, Each array consists of individual hole-like discharge apertures 23 communicating with the pressure chamber 10. The outlet apertures 23 are equipped with current guide edges 24 projecting into the air duct 13, which concentrically surround the outlet apertures 23 for reducing turbulence formation of the outflowing air at the edges of the hole. The current guide edges 24 can be created in a simple fashion by flanging (i.e. beveling) the edges of the holes 23 into the air duct 13. The outlet apertures of the series of nozzles 22, 22' are arranged (i.e. offset) in lateral displacement in relation to one another so that the air current emerging from each outlet aperture 23 hits the opposite partition 20, 20' lying opposite to it which forms in this area a deflector 25, 25' for the air current.

A series of additional inlet apertures 26 extending over the width of the web is provided along the lower boundary 21 of each air duct 13 which is connected fluidly with an intake duct 27 located in the interior of the housing 1 extending along the dir duct. The intake duct is formed by a partition 28 pulled around (i.e. substantially enclosing) the lower boundary 21 of an associated air duct 13 in the interior of the housing 1, which partition 28 is joined gas-tight with the duct partitions 20, 20' at a location below the inlet apertures 23. The intake duct 27 passes through the side covers 3, 3' on the ends of the device and opens, into the intake chamber 17 emplaced as described.

The course of the air currents of the device 100 in operation should be clarified through the double arrow labelled S in FIGS. 1 to 5. The air conducted through the air supply duct 6 by means of a blower (not depicted for purposes of simplicity) through the air inlet apertures 5 into the various sections of the pressure chamber 10, regulated with respect to amount by valve flaps 8. Emerging air currents from pressure chamber 10 are formed through the outlet apertures 23 which abliquely encounter duct partition 20, 20' lying opposite each aperture 23, acting as a deflector in this area. Owing to the Coanda effect, the air currents basically move along the duct partitions 20, 20' and pass onto the partition surfaces 14 through which an air cushion is formed above the partitions surfaces 14 which carries the travelling web B. Additional air is sucked into the air duct 13 through the inlet apertures 26 owing to the ejector action of the air emerging through the outlet aperture 23, which on the one hand counteracts the effect that the isobars follow, or at least in part follow, the contours of the air ducts. On the other hand the amount of, air available as a current of air for bearing the travelling web is increased without the inlet apertures 26 being actively charged with compressed air for this purpose.

The air reaching the partition surfaces 14 from the air ducts 13 according to the principle of the Coanda effects is preferably drawn, off over the long end of the partition surfaces 14 and finally arrives at the area of the established air current deflectors 18, where it is preferably fed into the inlet apertures 26 through the corresponding inlet aperture array intake chamber 17, 19, and the intake duct 27 of the intake chamber 17.

In this way, at least a part of the kinetic residual energy of the air flowing off over the long ends of the partition surfaces 14 is capture for reuse in addition to the ejector effect, in order to blow air into the air duct through the inlet apertures 26. Experiments have shown that the residual energy of the air flowing off can then be optimally used when the outlet apertures 23 provided in the one duct wall 20 of an air duct 13 are provided opposite the outlet apertures 23 provided in the other duct wall 20' of an adjacent air duct 13, so that this arrangement finds application with the form of construction of the device of the invention described.

What is claimed is:

1. In combination, a web and a device using a fluid medium for suspension guidance of said web moving in a given direction, said web having first and second opposing major surfaces, said device comprising:

a plurality of air ducts (13) each defined by a V-shaped surface comprised of first and second partitions (20, 20'), said air ducts provided adjacent to at least one of said first and second major surfaces of the web, each of said air ducts having a length at least equal to a width of the web, measured in a direction transverse to said given direction, first inlet apertures (26) being provided at spaced intervals along a base portion of the V-shaped surface of at least one of said air ducts (13) enabling the fluid medium to pass therethrough, said at least one of said air ducts being fluidly connected with an intake chamber (17) separated from a pressure chamber (10) by a fluid barrier, said intake chamber having at least one second inlet aperture (19), a first plurality of intermediate partition surfaces (14) being arranged intermediate adjacent ones of said air ducts, a second intermediate partition surface (15) being arranged between an upstream end of said device mad acid air duct positioned closest to the upstream end of said device and a third intermediate partition surface (15') being arranged between a downstream end of the device and said air duct positioned closest to said downstream end of said device (15), and an array of openings (22, 22') provided along at least one of said first and second partitions of each said air duct (13), said openings communicating with said pressure chamber (10), said pressure chamber receiving said fluid medium under pressure, wherein said at least one second inlet aperture (19) is located near a lateral end of one of said first intermediate partition surfaces (14), a deflector extending upwardly from said one of said first intermediate partition surfaces, arranged above said at least one second inlet aperture and deflecting downwardly into said at least one second inlet aperture, said fluid medium moving out from between said web and said device in said direction transverse to said given direction, said deflected fluid medium entering said intake chamber (17) through said at least one second inlet aperture, whereby the fluid medium entering the intake chamber (17) is emitted from said first inlet apertures (26).

2. The combination according to claim 1, wherein said first and second partitions (20, 20') of each of said ducts are arranged on opposite sides of and are substantially symmetrical about a surface of a respective plane (Q) extending transverse to said given direction and passing through a longitudinal axis of each duct, each of said planes intersecting the web (B) along a respective line (D).

3. The combination according to claim 2, wherein the transverse planes (Q) of said plurality of air ducts intersect one another along a common line ($L_1$).

4. The combination according to claim 3, wherein an angular distance between each pair of adjacent said transverse planes (Q) is substantially equal.

5. The combination according to claim 4, wherein the intermediate partition surfaces (14) are curved.

6. The combination according to claim 5, wherein the curvature radii of the intermediate partition surfaces (14) are equal to a constant.

7. The combination according to claim 2, wherein said array of openings (22, 22') of each said air duct comprises a plurality of individual apertures (23) each directing the fluid medium to a surface region (25') of the other one of the first and second partitions (20') of each said air duck said surface regions (25') serving to deflect the fluid medium toward said web (B).

8. The combination according to claim 7 wherein at least one of said intermediate partition surfaces has a convex curvature facing one of said first and second major surfaces of the web (B).

9. The combination according to claim 7, wherein fluid current guides (24) are provided, each concentrically surrounding a respective one of said individual apertures.

10. The combination according to claim 9, wherein the other one of said first and second partitions (20, 20') of said ducts (13) is provided with an array of openings each comprising an individual aperture and at least surface portions of said at least one of said first and second partitions (20, 20') of each said air duct deflect the fluid medium emerging from the apertures (23) of the other one of said second and first partitions of each said air duct.

11. The combination according to claim 10, wherein the individual apertures (23) of the at least one of the first and second partitions (20, 20') of each said air duct are laterally displaced in relation to the individual apertures (23) provided in the other one of the first and second partitions (20, 20') of each said air duct.

12. The combination according to claim 11, wherein the individual apertures (23) provided in the first partition (20, 20') of each of said air ducts (13) are each arranged opposite a respective one of the individual apertures (23) provided in the second partition (20, 20') of an adjacent one of said air ducts.

13. The combination according to claim 9 wherein at least one lateral portion of each of the first and second partitions (20, 20') has a convex curvature facing one of said first and second major surfaces of the web (B).

14. The combination according to claim 7, wherein the other one of said first and second partitions (20, 20') of said ducts is provided with an array of openings each comprising an individual aperture and at least portions of a surface of said at least one of said first and second partitions (20, 20') of each said air duct serve to deflect the fluid medium emerging from said individual apertures (23) of the other one of said second and first partitions of each said air duct toward said web (B).

15. The combination according to claim 14, wherein the individual apertures (23) of the at least one of the first and second partitions (20, 20') of each said air duct are laterally displaced in relation to the individual apertures (23) provided in the other one of the first and second partitions (20, 20') of each said air duct.

16. The combination according to by claim 15, wherein the individual apertures (23) provided in said first partition (20, 20') of each of said air ducts (13) are each arranged opposite a respective one of the individual apertures (23) provided in said second partition (20, 20') of an adjacent one of said air ducts.

17. The combination according to claim 14 wherein at least one lateral portion of each of the first and second partitions (20, 20) has a convex curvature facing one of said first and second major surfaces of the web (B).

18. The combination according to claim 2 wherein at least one of said intermediate partition surfaces has a convex curvature facing one of said first and second major surfaces of the web (B).

19. The combination according to claim 18, wherein said convex curvature of said at least one of said plurality of intermediate partition surfaces merges into a convex curvature surface of an adjacent one of said plurality of intermediate partition surfaces (14).

20. The combination according to claim 1, wherein said device has a given length measured in said given direction of movement of said web, first and second groups of stabilizing nozzles (16) communicating with the pressure chamber (10) being provided in said second and third intermediate partition surfaces (15, 15').

21. The combination according to claim 1, wherein the pressure chamber (10) is divided into separate compartments by compartment walls each extending parallel to the given direction of travel of the web (B), each separate compartment delivering the fluid medium under pressure from said pressure chamber to at least one of said openings along said at least one of said first and second partitions, and means for regulating pressure in the separate compartments.

22. The combination according to claim 21, wherein the means for regulating pressure are continuously adjustable valve plates (8) movably provided in the separate compartments.

23. The combination according to claim 1, wherein the first and second partitions of each duct define an acute angle (b), said first and second partitions of each duct being symmetrical about a plane (Q).

24. The combination according to claim 23, wherein the V-shaped surface of each air duct (13) has a lower boundary (21) adjacent to a vertex of the V-shaped surface of each said air duct.

25. The combination according to claim 24, wherein the first inlet apertures (26) extend alone a length of the lower boundary (21) of said at least one of said air ducts (13), and serve as air jets for introducing the fluid medium into the at least one of said air ducts drawn in by the effect of the fluid medium emitted from the array of openings (22, 22') of the at least one of said air ducts.

26. The combination according to claim 1, wherein said deflector comprises at least one curved guide sheet (18) for deflecting the fluid medium into said at least one second inlet aperture (19) and said intake chamber.

* * * * *